US006468673B2

(12) United States Patent
Saito

(10) Patent No.: US 6,468,673 B2
(45) Date of Patent: Oct. 22, 2002

(54) CAST IRON COMPONENT FOR ENVELOPED CASTING, ENVELOPED CASTING PRODUCT USING IT, AND METHOD FOR PRODUCING CAST IRON COMPONENT FOR ENVELOPED CASTING

(75) Inventor: Giichiro Saito, Yamagata (JP)

(73) Assignees: Teipi Industry Co., Ltd., Sagae (JP); Teikoku Piston Ring Co., Ltd., Tokyo (JP)

( * ) Notice: Subject to any disclaimer, the term of this patent is extended or adjusted under 35 U.S.C. 154(b) by 122 days.

(21) Appl. No.: 09/728,399

(22) Filed: Dec. 1, 2000

(65) Prior Publication Data

US 2001/0004498 A1 Jun. 21, 2001

(30) Foreign Application Priority Data

Dec. 15, 1999 (JP) ..... 11-356352

(51) Int. Cl.[7] ..... B32B 15/18; B22D 27/20

(52) U.S. Cl. ..... 428/653; 29/888.061; 29/527.1; 29/527.5; 106/38.22; 164/47; 164/98; 164/138; 428/612; 428/687; 428/457; 428/923

(58) Field of Search ..... 428/653, 612, 428/687, 457, 923; 164/47, 98, 138; 106/38.22; 29/888.061, 527.1, 527.5

(56) References Cited

U.S. PATENT DOCUMENTS

| | | | | |
|---|---|---|---|---|
| 4,005,991 A | 2/1977 | Uebayasi et al. | ..... | 428/653 |
| 6,286,210 B1 | 9/2001 | Rückert et al. | ..... | 164/100 |

FOREIGN PATENT DOCUMENTS

| | | |
|---|---|---|
| DE | 19750687 A | 5/1999 |
| DE | 19807685 A | 9/1999 |
| EP | 0532331 A | 3/1993 |
| GB | 1047774 A | 11/1966 |
| JP | 43-4842 | 2/1968 |
| JP | 2-29426 B | 6/1990 |
| JP | 8-290255 A | 11/1996 |

*Primary Examiner*—Robert R. Koehler
(74) *Attorney, Agent, or Firm*—Frishauf, Holtz, Goodman & Chick, P.C.

(57) ABSTRACT

The present invention provides a cast iron component for enveloped casting which is characterized by that the cast iron component has a surface to which enveloped casting is applied and which has a surface roughness such that a maximum height Ry is from 65 to 260 $\mu$m and a mean spacing of profile irregularities Sm is from 0.6 to 1.5 mm; an enveloped casting product using it; and a method for its production.

11 Claims, 2 Drawing Sheets

【Fig. 1】
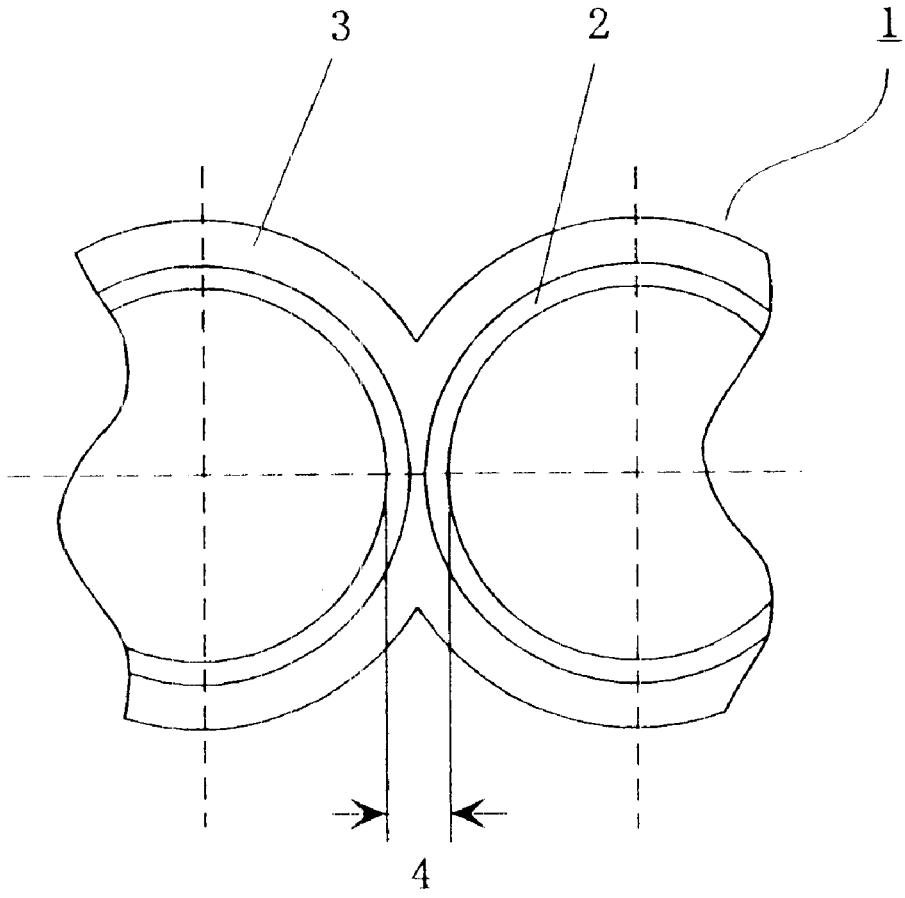

【Fig. 2】
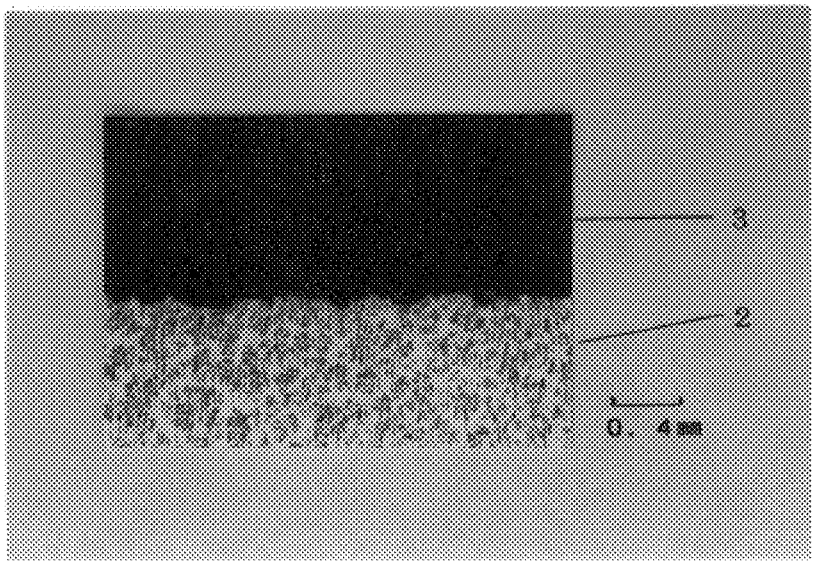
【Fig. 3】
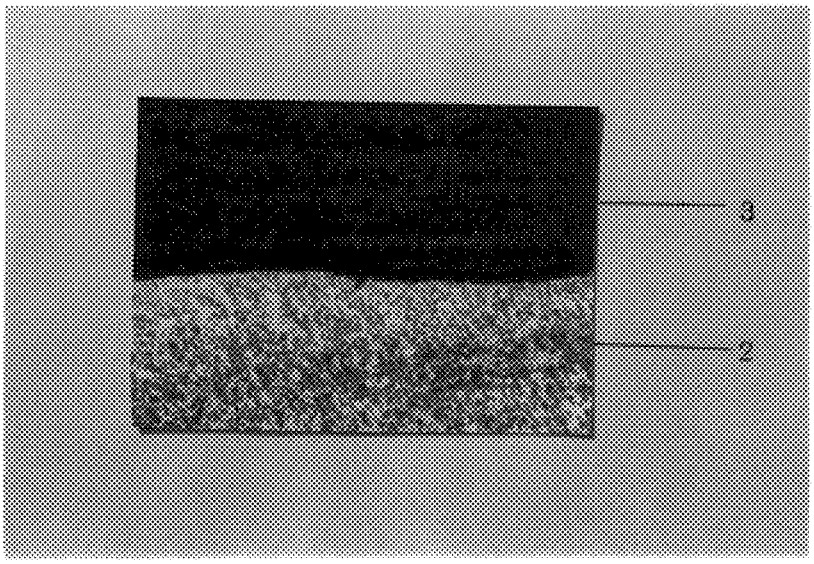

CAST IRON COMPONENT FOR ENVELOPED CASTING, ENVELOPED CASTING PRODUCT USING IT, AND METHOD FOR PRODUCING CAST IRON COMPONENT FOR ENVELOPED CASTING

TITLE OF THE INVENTION

Cast iron component for enveloped casting, enveloped casting product using it, and method for producing cast iron component for enveloped casting 1. Field of the Invention The present invention relates to a cast iron component for enveloped casting suitable for, for example, a cylinder liner or an insert for a brake drum; an enveloped casting product using it, and method for producing the cast iron component for enveloped casting.

2. Background of the Invention

In aluminum cylinder blocks for engines of automobiles (hereinafter referred to as cylinder block), cylinder liners (hereinafter sometimes referred to as liner) made of cast iron are often used in order to satisfy desired seizing resistance and wear resistance of a sliding surface. As a method for producing the cylinder block having the liner enveloped or embedded therein, a method for enveloped casting has been known wherein a liner is placed within a cast mold for the cylinder block and the periphery of the liner is enveloped with aluminum or an aluminum alloy (hereinafter referred to as an aluminum material).

In such a liner, it is required to secure adhesion between the outer face of the liner and the aluminum material to prevent the liner from rotating at the time of processing the inner face of the liner after the enveloped casting or to improve the engine performance by the reduction in the deformation of bores and the improvement of thermal conductivity. The following methods have been known to obtain a liner having a high adhesion with the aluminum material.

(1) a method wherein shot peening is applied to the outer face of the liner to provide irregularities on the outer face, thereby improving the adhesion (JP-B-2-29426).

(2) a method wherein spinies (acicular special cast surface) are formed on the outer face of the liner to improve the adhesion (JP-B-43-4842).

(3) a method wherein grooves in an axial direction are formed by machining the outer face of the liner to improve the casting properties of the block and the adhesion (JP-A-8-290255).

(4) a method wherein blast finishing is applied to the cast iron surface of the outer face of the liner. It has been known that the cast iron surface in this case is obtainable by a permanent mold centrifugal casting method or the like wherein a suspension containing from 20 to 40 mass % of diatomaceous earth having a mean particle size of not more than 0.1 mm, from 2 to 10 mass % of bentonite and from 65 to 80 mass % of water, is coated by spraying on the cast mold, and after drying it, a melt of cast iron is poured thereinto.

FIG. 1 shows an example of a cylinder block having a liner enveloped, which is produced by enveloping the liner. in this figure, 1 is a cylinder block having a liner enveloped, 2 is a liner, 3 is an aluminum material and 4 is the shortest interval between bores. Between the bores, as a wall, there are two liner 2 parts and an aluminum material 3 part sandwiched by them as illustrated in this figure. Conventionally, the shortest interval 4 between the bores has been set to be at least 9 mm. However, it has been recently demanded to set the shortest interval to be at most 8 mm, reflecting the tendency toward narrow inter-bore distance to satisfy the desired bore up or weight reduction.

For example, when an aluminum cylinder block having a liner enveloped as shown in FIG. 1 is made by die-casting, usually, the thinnest aluminum part between the bores solidifies at first, and then peripheral portions solidify. However, when the distance between the bores is narrowed, if the adhesion (anchor effect) between the liners and the aluminum material between the bores is insufficient, the thinnest aluminum material part is pulled at the time of shrinkage by solidification of its peripheral portions, whereby hot crack or hot tearing may sometimes be caused. Further, since the part between the bores solidifies at first, the aluminum material is hardly filled into dents on the outer face of the liner. Accordingly, as the liner for enveloped casting which satisfies the narrow inter-bore distance, it is demanded that the adhesion between the liner and the aluminum material is good, the filling property of the aluminum material into dents on the outer face of the liner is good even between the bores, and the thickness of the liner is thin.

However, the above methods (1) to (4) have the following drawbacks. For example, with the shot peening in the above method (1), the adhesion is insufficient, and further, since a soft ferrite structure is required to exist in a thickness of at least 2.0 mm, the thickness tends to increase. The spinies in the above method (2), although the adhesion is good, the irregularities on the outer face is at a level of about 1.0 mm and the thickness increases, and further, the filling property of the aluminum material into the dents of spinies is poor. In the machining of grooves in the above method (3), the thickness tends to increase entirely in order to secure the strength at the bottom of groove, and the cost tends to be high. The one in the above method (4) obtainable by blasting the cast iron surface has drawbacks, e.g. poor adhesion, although the filling property of the aluminum material is good and the price is low.

SUMMARY OF THE INVENTION

Accordingly, it is an object of the present invention to provide a cast iron component for enveloped casting which is excellent in the filling property of the aluminum material and the adhesion with the aluminum material at the time of die-casting; an enveloped casting product using it, and a method for producing the cast iron component for enveloped casting.

In order to accomplish the above objects, the present invention provides a cast iron component for enveloped casting (hereinafter referred to simply as "cast iron component") which is characterized by that the cast iron component has a surface to which enveloped casting is applied and which has a surface roughness such that a maximum height Ry is from 65 to 260 $\mu$m and a mean spacing of profile irregularities Sm is from 0.6 to 1.5 mm.

The cast iron component of the present invention preferably has the maximum height Ry within a range of from 75 to 250 μm and the mean spacing of profile irregularities Sm within a range of from 0.7 to 1.4 mm. More preferably, the surface to which enveloped casting is applied is a cast iron surface. Moreover, the cast iron component of the present invention is suitable for a cylinder liner or an insert for a brake drum.

The enveloped casting product of the present invention comprises the above cast iron component and aluminum or an aluminum alloy enveloping the cast iron component.

The enveloped casting product of the present invention is particularly suitable for a cylinder block or a brake drum. Further, when the enveloped casting product is a cylinder block, the cylinder block preferably has a shortest interval between bores of from 5.0 to 8.0 mm at the time of completion of the cylinder block.

Furthermore, the method for producing a cast iron component for enveloped casting of the present invention is a method for producing a cast iron component which has a surface to which enveloped casting is applied and which has a surface roughness such that a maximum height Ry is from 65 to 260 μm and a mean spacing of profile irregularities Sm is from 0.6 to 1.5 mm, by coating a facing on a heated inner face of a cast mold, drying it, and pouring a melt of cast iron into the cast mold for molding, wherein the facing is a suspension comprising from 20 to 45 mass % of silica sand having a mean particle size of from 0.05 to 0.5 mm, from 10 to 30 mass % of silica flour having a mean particle size of not more than 0.1 mm, from 2 to 10 mass % of a binder and from 30 to 60 mass % of water.

In the method of the present invention, preferably, the coating of the facing and the pouring of the melt of cast iron are carried out while rotating the cast mold.

According to the present invention, the cast iron component has a surface to which enveloped casting is applied and which has a surface roughness such that a maximum height Ry is from 65 to 260 μm and a mean spacing of profile irregularities Sm is from 0.6 to 1.5 mm, and when, for example, an aluminum material is die-cast on the outer face of the cast iron component, the filling property of the aluminum material into the irregularities is excellent, and an enveloped casting product excellent in the adhesion with the aluminum material can be obtained. Accordingly, when the present invention is applied to, for example, a cylinder liner, the liner and the aluminum material are fixedly adhered and it is thereby possible to prevent hot cracks or the like of the aluminum material in narrow distance between bores.

Further, according to the method of the present invention for producing the cast iron component for enveloped casting, by using, as a facing, a suspension comprising from 20 to 45 mass % of silica sand having a mean particle size of from 0.05 to 0.5 mm, from 10 to 30 mass % of silica flour having a mean particle size of not more than 0.1 mm, from 2 to 10 mass % of a binder and from 30 to 60 mass % of water, it is possible to easily obtain a cast iron surface which has a surface roughness such that a maximum height Ry is from 65 to 260 μm and a mean spacing of profile irregularities Sm is from 0.6 to 1.5 mm. Accordingly, by using this cast iron surface as a surface to which enveloped casting is applied, it is possible to obtain an enveloped casting product excellent in the adhesion between the cast iron component and the surrounding aluminum material on its periphery as mentioned above.

BRIEF DESCRIPTION OF THE DRAWINGS

FIG. 1 is a schematic view showing a cross section of a cylinder block having a liner enveloped therein.

FIG. 2 shows a microscopic photograph of a cross section of the surface of the liner in Example 1 to which enveloped casting is applied.

FIG. 3 shows a microscopic photograph of a cross section of the surface of the liner in Comparative Example 3 to which enveloped casting is applied.

DESCRIPTION OF THE PREFERRED EMBODIMENTS

Hereinafter, the present invention will be described in further detail with reference to preferred embodiments.

In the present invention, composition of the cast iron to be used for the cast iron component is not particularly limited. However, it is preferably, for example, a composition of C: 2.9 to 3.6 (mass %, hereinafter the same applies), Si: 1.6 to 2.8, Mn: 0.5 to 1.0 and P: 0.05 to 0.4. Further, as the case requires, Cr: 0.1 to 0.4, B: 0.03 to 0.08 and Cu: 0.3 to 0.5 may be added.

Further, in the enveloped casting product of the present invention, as the metal to be poured around the cast iron component, an aluminum material, namely, aluminum or an aluminum alloy is used. As the aluminum alloy, ADC 10 of JIS H5302 (analogous alloy of AA B380.0), ADC 12 of JIS H5302 (analogous alloy of AA 383.0), etc. may be used.

In the measurement of the surface roughness as defined in the present invention, since the distribution of the surface roughness spreads over plural grades of standard, the measurement conditions are set to have a reference length of 2.5 mm and an evaluation length of 12.5 mm for convenience. Further, the cut-off value is set to be 2.5 mm to remove surface waviness component as thoroughly as possible (the same applies to examples hereinbelow).

In the cast iron component of the present invention, with the surface roughness of the surface to which enveloped casting is applied, it is preferred that the maximum height Ry is from 65 to 260 μm and the mean spacing of profile irregularities Sm is from 0.6 to 1.5 mm, and it is more preferred that the maximum height Ry is from 75 to 250 μm and the mean spacing of profile irregularities Sm is from 0.7 to 1.4 mm. By adjusting these values within the above ranges, it is possible to improve the filling property of the aluminum material into the irregularities on the surface to which enveloped casting is applied at the time of die-casting, and to strengthen the adhesion between the cast iron component and the aluminum material.

Here, if Ry is less than 65 μm, the joint strength by anchor effect with the aluminum material is inadequate and the adhesion is insufficient, such being undesirable. Further, if Ry exceeds 260 μm, the filling property of the aluminum material or the like is poor, cavities are formed between the cast iron component and the aluminum material, and the heat dissipation property deteriorates, such being undesirable. Moreover, if Ry exceeds 260 μm, particularly when the cast iron component is a liner or an insert and when the thickness is reduced, it is impossible to assure the uniformity of a sliding face material or the outer diameter precision, such being undesirable.

On the other hand, if Sm is less than 0.6 mm, the filling property of the aluminum material is worsened and the die-casting conditions are difficult to control, such being undesirable. Further, if Sm exceeds 1.5 mm, the anchor effect between the periphery of the cast iron component and the aluminum material deteriorates, the adhesion becomes insufficient, and hot cracks are likely to form at the time of solidification of the aluminum material, such being undesirable.

With the cast iron component of the present invention, difference in level or groove portions are unlikely to form on the periphery, and macroscopically, when the periphery is made to be straight i.e. flat without macroscopic irregularities, the thickness can be reduced more effectively.

The cast iron component of the present invention is preferably used for cylinder liners of internal combustion engines or compressors, inserts of brake drums, and the like. Particularly, when it is used for liners of cylinder blocks of automobile engines, it is possible to prevent hot cracks in the aluminum material at the shortest interval between bores at the time of die-casting. Further, it is possible to adjust the thickness of the liner to be not more than 2.5 mm and the thickness of the aluminum material between the bores to be not more than 3 mm at the time of completion of the cylinder block, whereby the cast iron component of the present invention is particularly suitable for liners to be enveloped in cylinder block having narrow bore intervals of not more than 8 mm.

Further, as the enveloped casting product of the present invention having the cast iron component enveloped therein, cylinder blocks for compressors or engines of automobiles, and brake drums may, for example, be mentioned.

In the method of the present invention for producing the cast iron component, as a facing, a suspension containing from 20 to 45 mass % of silica sand having a mean particle size of from 0.05 to 0.5 mm, from 10 to 30 mass % of silica flour having a mean particle size of not more than 0.1 mm, from 2 to 10 mass % of a binder and from 30 to 60 mass % of water, is used.

The facing usually has a function as a refractory (or release agent) to prevent the seizing (welding) of a melt to a cast mold, and a function as a thermal insulating material to control the cooling rate in order to obtain an adequate material.

Silica sand and silica flour are bases for a facing, and are usually used as a single component. However, in the facing used in the present invention, the mean particle size of silica sand is an element to determine the level of the cast iron surface roughness, whereas silica flour takes part in determining the uniformity of the facing. Further, the binder take part in securing the strength of the facing by binding them. As the binder used in the present invention, bentonite, syrup, sodium silicate (water glass) starch and the like may be mentioned. The water content takes part in controlling the generated amount of steam which affects the level of the cast iron surface roughness and the intervals. In the present invention, by mixing the above respective components at a specific ratio for use, the cast iron surface roughness as defined in the present invention can be obtained.

In the present invention, the maximum height Ry of the surface roughness is determined by the mixing ratio of silica sand and silica flour. Namely, as the ratio of silica sand increases, Ry increases. Further, as the water content increases, the mean spacing of profile irregularities increases, and as the ratio of silica sand increases, the mean spacing of profile irregularities decreases.

Accordingly, in the present invention, for example, when the ratio of silica sand and silica flour is constant, if the mean particle size of silica sand exceeds 0.5 mm, Ry becomes too large, and if it is less than 0.05 mm, Ry becomes too small, such being undesirable. Further, if the enveloped amount of the binder is less than 2 mass %, Ry becomes too large, and if it exceeds 10 mass %, Ry becomes too small, such being undesirable. Then, if the water content exceeds 60 mass %, Sm becomes too large, and if it is less than 30 mass %, Sm becomes too small, such being undesirable.

Further, with the enveloped amount of silica sand and silica flour, if silica sand exceeds 45 mass %, Sm becomes too small, and if it is less than 20 mass %, Sm becomes too large, such being undesirable. Furthermore, if silica flour is less than 10 mass %, the facing becomes uneven, and if it exceeds 30 mass %, Ry becomes too small, such being undesirable.

The method of the present invention for producing a cast iron component is a method wherein a facing is coated on a heated inner face of a cast mold, and dried, and then a melt of cast iron is poured into the cast mold for molding. In this case, preferred is a so-called a centrifugal casting method wherein the coating of the facing and the pouring of the cast iron is carried out while rotating the cast mold. Otherwise, a sand casting method or other casting methods and processing methods may be employed.

The cast mold temperature and the coating thickness of the facing are not particularly limited and may be appropriately determined. However, particularly preferably, the cast mold temperature is from 200 to 350° C. and the thickness of the facing is from 0.5 to 2.0 mm.

In the method of the present invention for producing the cast iron component, by coating the facing of the above composition, numerous fine dents are formed by the pores through which steam comes out which is generated from the facing at the time of drying by the heat of the cast mold. Then, by pouring a melt of cast iron thereinto, the cast iron component having the surface to which the enveloped casting is applied and which has a surface roughness as defined above, can be obtained only by casting without special post-processing treatment or the like. Namely, the cast iron surface as itself is a surface having the surface roughness and the mean spacing of profile irregularities as defined in the present invention, and therefore the cast iron surface can be utilized as the surface to which the enveloped casting is applied without applying any special processing treatment or the like.

EXAMPLES

Hereinafter, the present invention will be described in further detail with reference to examples and comparative examples.

In respective examples and comparative examples, the material of the liner was at a level of FC200 of JIS G5501 and the thickness of the liner was 8 mm.

Examples 1 to 4

Respective liners were prepared by a permanent mold centrifugal casting method by using respective facings as indicated in Table 1. Specifically, on the inner face of a cast mold heated to 200 to 350° C., each of the respective facings was coated by spraying to a thickness of from 0.5 to 2.0 mm, and dried, and then a melt of cast iron was poured thereinto.

TABLE 1

| | Ex. 1 | Ex. 2 | Ex. 3 | Ex. 4 |
|---|---|---|---|---|
| Silica sand | | | | |
| Mean particle size (mm) | 0.2 | 0.5 | 0.2 | 0.5 |
| Mass % | 40 | 30 | 30 | 36 |
| Silica flour | | | | |
| Mean particle size (mm) | at most 0.1 | at most 0.1 | at most 0.1 | at most 0.1 |
| Mass % | 20 | 15 | 15 | 18 |
| Bentonite (mass %) | 5 | 3 | 8 | 5 |
| Water content (mass %) | 35 | 52 | 47 | 41 |

Comparative Examples 1 to 3

Respective liners were prepared in the same manner as in Examples provided that the respective facings indicated in Table 2 were used.

TABLE 2

| | Comp. Ex. 1 | Comp. Ex. 2 | Comp. Ex. 3 |
|---|---|---|---|
| Silica sand | | | |
| Mean particle size (mm) | 0.1 | 0.5 | — |
| Mass % | 37 | 50 | — |
| Silica flour | | | |
| Mean particle size (mm) | at most 0.1 | at most 0.1 | — |
| Mass % | 32 | 10 | — |
| Diatomaceous earth | | | |
| Mean particle size (mm) | — | — | at most 0.1 |
| Mass % | — | — | 25 |
| Bentonite (mass %) | 5 | 3 | 5 |
| Water content (mass %) | 26 | 37 | 70 |

In preparation of a cylinder block of an in-line four-cylinder gasoline engine having a displacement of 1.5 liters, an aluminum material was die-cast on the outer face of each of various liners with different outer surface roughness which were obtained in accordance with Examples 1 to 4 and Comparative Examples 1 to 3 or methods similar to Examples 1 to 4 and Comparative Examples 1 to 3 provided that the mean particle size or incorporated amount of silica sand was changed or the incorporated amount of silica flour, diatomaceous earth, bentonite or water was changed. Then, the adhesion between the liner and the aluminum material, and the filling property of the aluminum material into irregularities on the outer face of the liner, were examined. The material of the aluminum material was ADC12, and the die-casting conditions were set to have a casting pressure of 65 Mpa, a casting rate of 0.3 m/s and a melt temperature of 670° C. Further, the thickness of the liner was 2 mm and the thickness (shortest distance) between the bores was 7 mm at the time of completion of the block.

In evaluation of the adhesion, the cylinder block having the liner enveloped after die-casting was cut into small pieces, and the one which showed no peeling between the liner and the aluminum material up to the size of 5 mm ×5 mm was indicated as "o"; the one, up to the size of 20 mm×20 mm was indicated as "Δ"; and the one showed peeling at the size larger than 20 mm×20 mm was indicated as "x". Further, with the filling property of the aluminum material, the boundary portion between the liner and the aluminum material (hereinafter referred to as boundary portion) after die-casting, was ground, and then the surface was observed by a microscope, and the evaluation was made by the size of cavities. The results are shown in Table 3. The sample for the test of adhesion was taken at the position farthest from a gate, and the sample for the test of filling property was taken at the position between the bores.

TABLE 3

| | | Sm (mm) | | | | | | |
|---|---|---|---|---|---|---|---|---|
| | | 0.5 | 0.6 | 0.7 | 1.0 | 1.4 | 1.5 | 1.6 |
| Ry (μm) | | | | | | | | |
| 50 | Adhesion | x | x | x | x | x | x | x |
| | Filling prop. | x(C1) | Δ | Δ | ○ | ○ | ○ | ○ |
| 65 | Adhesion | x | Δ | Δ | Δ | Δ | Δ | x |
| | Filling prop. | x | Δ(E1) | Δ | ○ | ○ | ○ | ○(C3) |
| 75 | Adhesion | x | Δ | ○ | ○ | ○ | Δ | x |
| | Filling prop. | Δ | Δ | ○ | ○ | ○(E3) | ○ | ○ |
| 100 | Adhesion | x | ○ | ○ | ○ | ○ | Δ | x |
| | Filling prop. | Δ | Δ | ○ | ○ | ○ | ○ | ○ |
| 200 | Adhesion | Δ | ○ | ○ | ○ | ○ | Δ | x |
| | Filling prop. | x | Δ | ○ | ○ | ○ | ○ | Δ |
| 250 | Adhesion | Δ | Δ | ○ | ○ | ○ | Δ | x |
| | Filling prop. | x | Δ | ○(E4) | ○ | ○ | ○ | x |
| 260 | Adhesion | Δ | Δ | ○ | ○ | ○ | Δ | x |
| | Filling prop. | x | Δ | Δ | Δ | Δ | Δ(E2) | x |
| 270 | Adhesion | Δ | Δ | Δ | Δ | x | x | x |
| | Filling prop. | x | x(C2) | x | x | x | x | x |

Note:
In the table, E1 to E4 correspond to Examples 1 to 4 and C1 to C3 correspond to Comparative Examples 1 to 3.

From the results of Table 3, it is apparent that excellent adhesion and filling property can be obtained as far as the maximum height Ry is within a range of from 65 to 260 μm and the mean spacing of profile irregularities Sm is within a range of from 0.6 to 1.5 mm. Then, it is also apparent that particularly excellent results can be obtained when Ry is within a range of from 75 to 250 μm and Sm is within a range of from 0.7 to 1.4 mm.

Further, FIG. 2 shows a macroscopic photograph of the boundary portion of the cylinder block obtained by die-casting of the aluminum material by using the liner of Example 1. FIG. 3 shows a similar macroscopic photograph of the boundary portion of the cylinder block obtained by using the liner of Comparative Example 3. From these figures, it is found that when the liner of Example 1 is used, the aluminum material was filled into the irregularities on the outer face of the liner and its anchor effect improved the adhesion strength.

As explained above, according to the cast iron component of the present invention, when an aluminum material is die-cast around the periphery of the cast iron material, the filling property of the aluminum material into the irregularities on the outer face of the cast iron material is excellent, and at the same time, the adhesion with the aluminum material is improved, whereby it is possible to obtain an enveloped casting product excellent in the adhesion strength of the both, the thermal conductivity and the like. Accordingly, for example, when the present invention is applied to a cylinder liner, the liner and the aluminum material are firmly adhered or jointed, and hot cracks of the aluminum material between the narrow portion between bores can be prevented.

Further, according to the method of the present invention for producing the cast iron component, by using a specific composition as a facing, it is possible to obtain a cast iron surface having the specific surface roughness, i.e. the specific maximum height and mean spacing of profile irregularities as defined in the present invention. Accordingly, by using this cast iron surface as a surface to which enveloped casting is applied, it is possible to obtain a cast iron material having the above excellent properties without requiring a post-treatment or the like.

What is claimed is:

1. A cast iron component for enveloped casting which is characterized by that the cast iron component has a surface to which enveloped casting is applied and which has a surface roughness such that a maximum height Ry is from 65 to 260 $\mu$m and a mean spacing of profile irregularities Sm is from 0.6 to 1.5 mm.

2. The cast iron component according to claim 1, wherein the maximum height Ry is from 75 to 250 $\mu$m and the mean spacing of profile irregularities Sm is from 0.7 to 1.4 mm.

3. The cast iron component according to claim 1, wherein the surface to which enveloped casting is applied is a cast iron surface.

4. The cast iron component according to claim 1, wherein the cast iron component is a cylinder liner.

5. The cast iron component according to claim 1, wherein the cast iron component is an insert for a brake drum.

6. An enveloped casting product, which comprises the cast iron component as defined in claim 1 and aluminum or an aluminum alloy enveloping the cast iron component.

7. The enveloped casting product according to claim 6, wherein the cast iron component is a cylinder liner and the enveloped casting product is a cylinder block.

8. The enveloped casting product according to claim 7, wherein the cylinder block has a shortest interval between bores of from 5.0 to 8.0 mm at the time of completion of the cylinder block.

9. The enveloped casting product according to claim 6, wherein the cast iron component is an insert and the enveloped casting product is a brake drum.

10. A method for producing a cast iron component for enveloped casting which has a surface to which enveloped casting is applied and which has a surface roughness such that a maximum height Ry is from 65 to 260 $\mu$m and a mean spacing of profile irregularities Sm is from 0.6 to 1.5 mm, by coating a facing on a heated inner face of a cast mold, drying it, and pouring a melt of cast iron into the cast mold for molding, wherein the facing is a suspension comprising from 20 to 45 mass % of silica sand having a mean particle size of from 0.05 to 0.5 mm, from 10 to 30 mass % of silica flour having a mean particle size of not more than 0.1 mm, from 2 to 10 mass % of a binder and from 30 to 60 mass % of water.

11. The method according to claim 10, wherein the coating of the facing and the pouring of the melt of cast iron are carried out while rotating the cast mold.

* * * * *